US006000101A

United States Patent [19]

Többen

[11] Patent Number: 6,000,101

[45] Date of Patent: Dec. 14, 1999

[54] TEXTILE PROCESSING MACHINE HAVING PNEUMATIC PRESSURE-GENERATING MEANS

[75] Inventor: Robert Többen, Mönchengladbach, Germany

[73] Assignee: Trützschler GmbH & Co. KG, Mönchengladbach, Germany

[21] Appl. No.: 09/049,074

[22] Filed: Mar. 27, 1998

[30] Foreign Application Priority Data

Mar. 29, 1997 [DE] Germany ..... 197 13 255

[51] Int. Cl.[6] ..... D01H 5/72

[52] U.S. Cl. ..... 19/288

[58] Field of Search ..... 19/150, 239, 288, 19/106 R, 159 R, 270, 272, 286, 157

[56] References Cited

U.S. PATENT DOCUMENTS

| | | | |
|---|---|---|---|
| 4,485,528 | 12/1984 | Anahara et al. | 19/288 X |
| 4,763,387 | 8/1988 | Bothner . | |
| 5,666,698 | 9/1997 | Nauthe et al. | 19/150 X |
| 5,815,890 | 10/1998 | Leifeld | 19/150 X |

FOREIGN PATENT DOCUMENTS

| | | | |
|---|---|---|---|
| 1376399 | 9/1964 | France . | |
| 33 25 422 | 1/1984 | Germany . | |
| 36 12 133 | 10/1987 | Germany . | |
| 37 26 628 | 2/1989 | Germany . | |
| 38 01 688 | 7/1989 | Germany . | |
| 38 07 582 | 9/1989 | Germany . | |
| 38 04 147 | 2/1991 | Germany . | |
| 195 28 484 | 2/1997 | Germany . | |
| 683846 | 5/1994 | Switzerland . | |
| 2222836 | 3/1990 | United Kingdom | 19/150 |

*Primary Examiner*—Ismael Izaguirre
*Attorney, Agent, or Firm*—Venable; Gabor J. Kelemen

[57] ABSTRACT

A fiber processing system includes a fiber processing machine having a sliver guiding element through which a sliver runs; and a separate device which generates a low pneumatic pressure and which supplies a pneumatic stream to the sliver guiding element.

10 Claims, 5 Drawing Sheets

S1
S2
P1
P3
P4
A
B
C
I
II
III
1
2
3
4
5
6
7
8
9
10
11
12
15
15'
16
17
18
19
19'
20
22
22a
22b
22c
22d
23
24
25
26
27
28
29
30
31
33
96a
96b
96c
96d

TEXTILE PROCESSING MACHINE HAVING PNEUMATIC PRESSURE-GENERATING MEANS

CROSS REFERENCE TO RELATED APPLICATION

This application claims the priority of German Application No. 197 13 255.3 filed Mar. 29, 1997, which is incorporated herein by reference.

BACKGROUND OF THE INVENTION

This invention relates to a textile processing machine such as a drawing frame, a carding machine or the like which utilizes pneumatic pressure and which has at least one sliver guiding element such as a sliver trumpet through which the sliver runs and which is supplied with pressurized air.

In known drawing frames whose upper drawing rolls are loaded pneumatically, a central pneumatic conduit for the drawing frames is provided. From the central pneumatic conduit several branch conduits lead to the individual drawing frames. The pressure in the central pneumatic conduit and in the branch conduits is high (approximately 6–8 bar); for loading the upper rolls high pressure is required. The quantity of the pressurized air, however, is small because it is consumed only during the loading of the upper rolls. In contrast, the pressurized air which is supplied to the sliver trumpet has a low pressure of, approximately, 0.4 bar, and the quantity of air consumed by the sliver trumpet is large because a continuous supply of the air stream is needed. Conventionally, in order to generate the low pressure for the pressurized air stream intended for the sliver trumpet, in each branch conduit a pressure reducing valve is inserted. This arrangement is disadvantageous in that the generation of a large quantity of pressurized air of low pressure for the sliver trumpet involves a high energy input, resulting in a low efficiency of energy utilization.

SUMMARY OF THE INVENTION

It is an object of the invention to provide an improved system of the above-outlined type from which the discussed disadvantages are eliminated and which, in particular, permits, in an economical manner, a reduction of the energy input for generating a low-pressure air stream.

This object and others to become apparent as the specification progresses, are accomplished by the invention, according to which, briefly stated, the fiber processing system includes a fiber processing machine having a sliver guiding element through which a sliver runs; and a separate device which generates a low pneumatic pressure and which supplies a pneumatic stream to the sliver guiding element.

By generating a low pneumatic pressure according to the invention by means of a separate device, the high energy input which is necessary in known apparatus for generating pressurized air which has to be subsequently reduced to a lower pressure may be dispensed with. By means of the measures according to the invention the consumption of high-pressure air—whose generation involves substantial expense—is very substantially reduced. By such a reduction of the energy input the efficiency of the textile fiber processing machine and the efficiency of the manufacturing methods are significantly improved. Even if, for a continuous air stream (for example, for cleaning and/or cooling the sliver trumpet or the like) a large air quantity is required, the efficiency based on the economical generation of the low pneumatic pressure according to the invention is improved.

The improvement manifests itself particularly in that despite the increased structural input involving a separate compressor, a very substantial increase of efficiency is obtained.

The invention has the following additional advantageous features:

An additional device is provided for generating pressurized air with high pressure, for example, for the loading devices of the drawing rolls of a drawing frame. The apparatus for generating pressurized air of low pressure is a compressor, for example, a rotary vane compressor generating pressurized air of approximately 0.3 to 0.5 bar. To the compressor a sliver trumpet is connected which is situated in the input zone of the drawing frame and which is a measuring trumpet for the sliver. A sliver guide situated in the input region of the drawing unit is connected to the compressor. The sliver guide is configured as a measuring device for the slivers. A sliver guide situated in the outlet region of the drawing unit is connected to the compressor and is designed for introducing the sliver bundle into the calender rolls while protecting the sliver bundle from air currents. A sliver trumpet situated at the outlet zone of the carding machine is connected to the compressor and is configured as a measuring trumpet for the exiting sliver. A group of textile processing machines, for example, drawing frames or carding machines or the like are connected to the compressor, and the air stream is used for blowing out the deposited dust and/or for cooling the measuring location. Pressurized air is supplied to a nozzle for advancing the sliver exiting the sliver guide. Each textile processing machine is provided with a separate compressor to generate low-pressure air.

DESCRIPTION OF THE PREFERRED EMBODIMENTS

Figure 1:
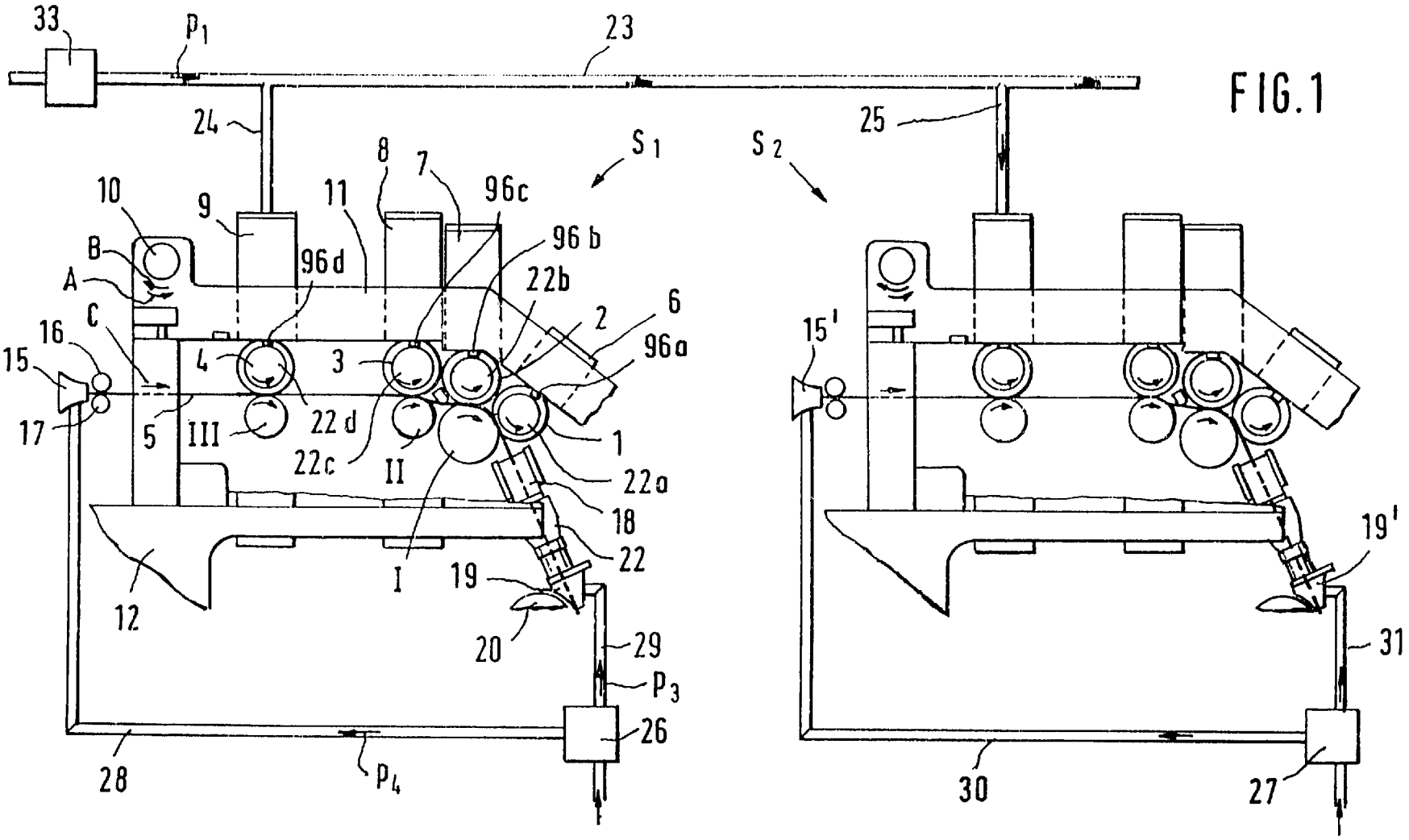
FIG. 1 is a schematic side elevational view of two drawing frames each provided, according to the invention, with their own device for generating a low pneumatic pressure.

Turning to FIG. 1, drawing units $S_1$ and $S_2$ are illustrated which form part of respective drawing frames such as, for example, HS models manufactured by Trützschler GmbH & Co. KG, Mönchengladbach, Germany. The drawing units $S_1$ and $S_2$ are 4-over-3 drawing units, that is, each has a lower output roll I, a lower mid roll II and a lower input roll III as well as four upper rolls 1, 2, 3 and 4. The drawing units $S_1$ and $S_2$ draw respective sliver bundles 5, each composed of a plurality of individual slivers and running in the direction C. The drawing system of each drawing unit is divided into preliminary and principal drawing fields. The roll pairs 4/III and 3/II form the preliminary drawing field whereas the roll pair 3/II and the three rolls 1, 2/I constitute the principal drawing field.

The lower output roll I is driven by a non-illustrated principal motor and thus defines the delivery speed. The lower input roll and lower mid roll III and II, respectively, are driven by a non-illustrated regulating motor. The upper rolls 1–4 are pressed against the lower rolls I, II and III by pressing elements 6, 7, 8 and 9 with the intermediary of pressing arms 11 (only one is visible) pivotal in a vertical plane about a bearing 10. The lower rolls I, II and III are driven from the respective, engaging upper roll by means of frictional contact. The lower rolls I, II and III are supported in roller stands 13 (FIG. 6) mounted on the machine frame 12. The pressing arms 11 serve for the shiftable accommodation of two pressure roll (upper roll) holders 14 (only one is visible in FIG. 6) which receive the respective pressure rolls 1, 2, 3 and 4.

As shown in FIG. 1, at the input of the drawing units $S_1$ and $S_2$ a sliver guide 15 is provided (shown in more detail in FIG. 4) which is associated with withdrawing rolls 16 and 17 and which may be constructed, for example, as disclosed in German published application P 44 04 326.0. At the output of the drawing unit a collecting element 18 (sliver guide) is provided for causing a convergence of the slivers to re-form a sliver bundle. Downstream of the collecting element 18 a sliver trumpet 19 is arranged from which the densified sliver bundle is withdrawn with high speed by two withdrawing rolls 20, 21. Between the gathering element 18 and the sliver trumpet 19 a twisting nozzle 22 is provided for threading the sliver into the sliver trumpet 19 to start the operation. The twisting nozzle 22 may be constructed, for example, as disclosed in German Patent No. 3,034,812.

Figure 6:
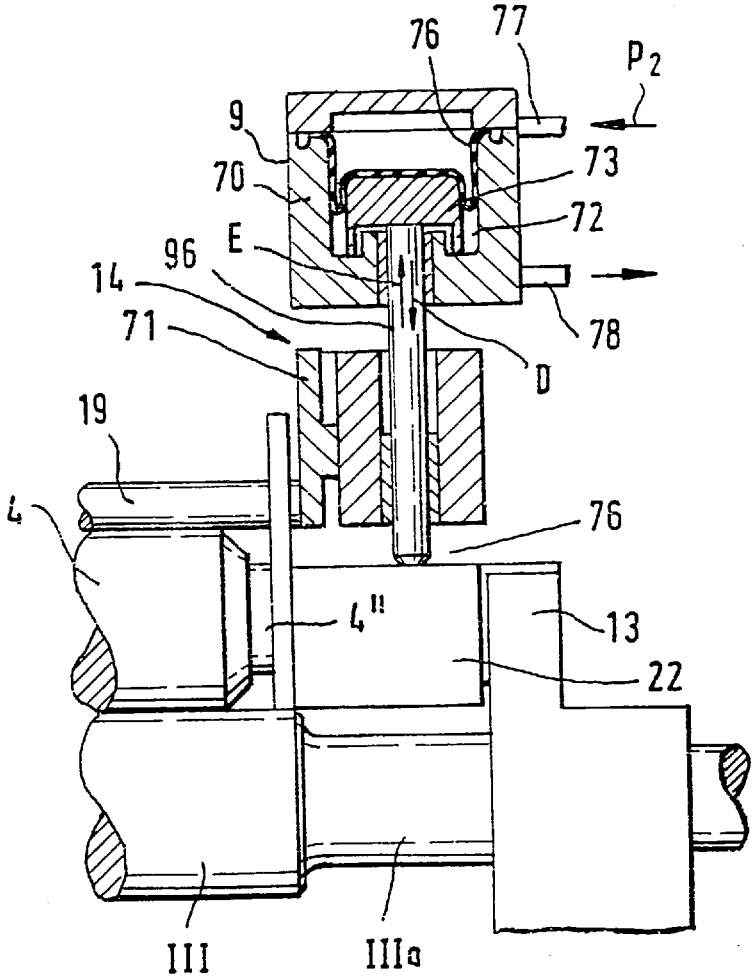
FIG. 6 is a schematic sectional view taken along line VII—VII of FIG. 6 illustrating a high-pressure pneumatic loading device for an upper drawing roll.

Further, a central pneumatic conduit 23 is provided from which a plurality of branch conduits (such as 24 and 25) extend. The branch conduit 24 leads to the drawing unit $S_1$ whereas the branch conduit 25 leads to the drawing unit $S_2$. The pressure $p_1$ in the central pneumatic conduit 23 and in the branch conduits 24 and 25 is high and amounts to, for example, 6–8 bar. The branch conduits 24 and 25 are connected with the pneumatic loading devices 6–9 for pressing down on the upper drawing rolls 1–4 (FIG. 6).

According to the invention, with each drawing unit $S_1$ and $S_2$ respective separate rotary vane compressors 26 and 27 are associated (FIG. 3) which generate compressed air in the conduits 28, 29; 30, 31 having a low pressure $p_3$, $p_4$ of, for example, 0.4 bar. From the rotary vane compressor 26 of the drawing unit $S_1$ pneumatic conduits 28 and 29 extend to the sliver guide 15 and the sliver trumpet 19, respectively. Likewise, from the rotary vane compressor 27 of the drawing unit $S_2$ pneumatic conduits 30 and 31 extend to the sliver guide 15' and the sliver trumpet 19', respectively.

Figure 2:
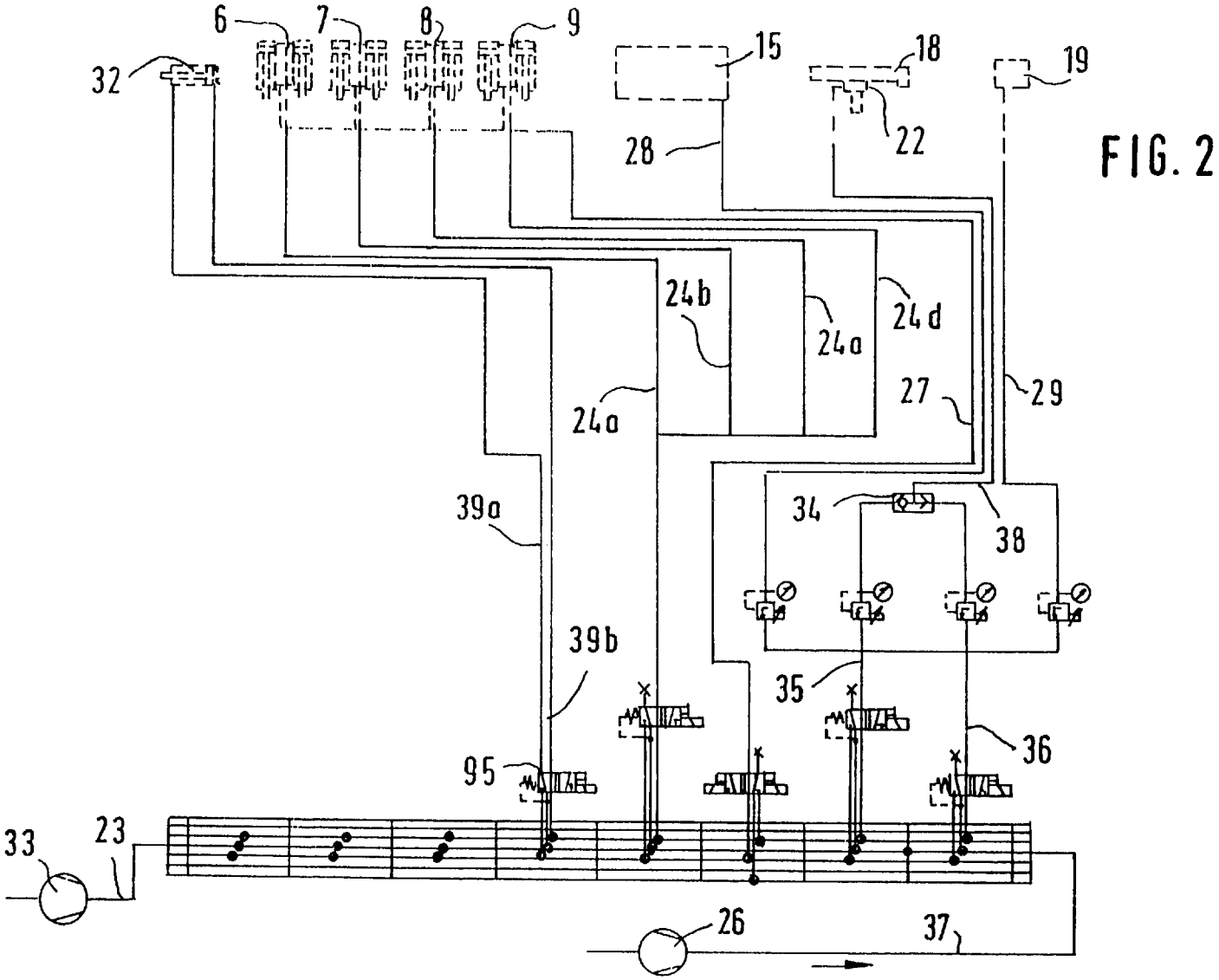
FIG. 2 is a block diagram of a pneumatic control circuit of a drawing frame including the device according to the invention.

Further, with the withdrawing rolls 16, 17 a pneumatic roll-loading device 32 (FIG. 2) is associated which operates with the higher pressure $p_1$ and by means of which the withdrawing roll 16 may be lifted or lowered.

Turning once again to FIG. 2, a compressor 33 is connected to the central pneumatic conduit 23 from which branch conduits extend to the various assemblies. Thus, branch conduits 24*a*, 24*b*, 24*c* and 24*d* lead to the pressing elements 6, 7, 8 and 9, respectively, of the drawing frame $S_1$. Further, to the pneumatic conduit 37 a low-pressure generating rotary vane compressor 26 is connected. A branch conduit 28 extends from the conduit 37 and leads to the sliver guide 15, while a branch conduit 29 leads to the sliver trumpet 19. Further, a switch-over valve 34 is provided which, at its input is connected by a conduit 35 to the high-pressure conduit 23 and is further connected by a conduit 36 to the low-pressure conduit 37. The valve 34 may be switched between high and low pressures. The output conduit 38 leads to the twisting nozzle 22 of the gathering element 18, and through the conduit 23 a high-pressure pneumatic pulse is delivered to the twisting nozzle 22, only to initiate the thread-in operation. Otherwise, through the conduit 37 a continuous, low-pressure pneumatic flow is maintained which serves for removing dust and the like. By means of a 5/2-way valve 95 the conduits 39*a*, 39*b* couple the pneumatic conduit 23 with the pneumatic withdrawing roll loading element 32.

Figure 3:
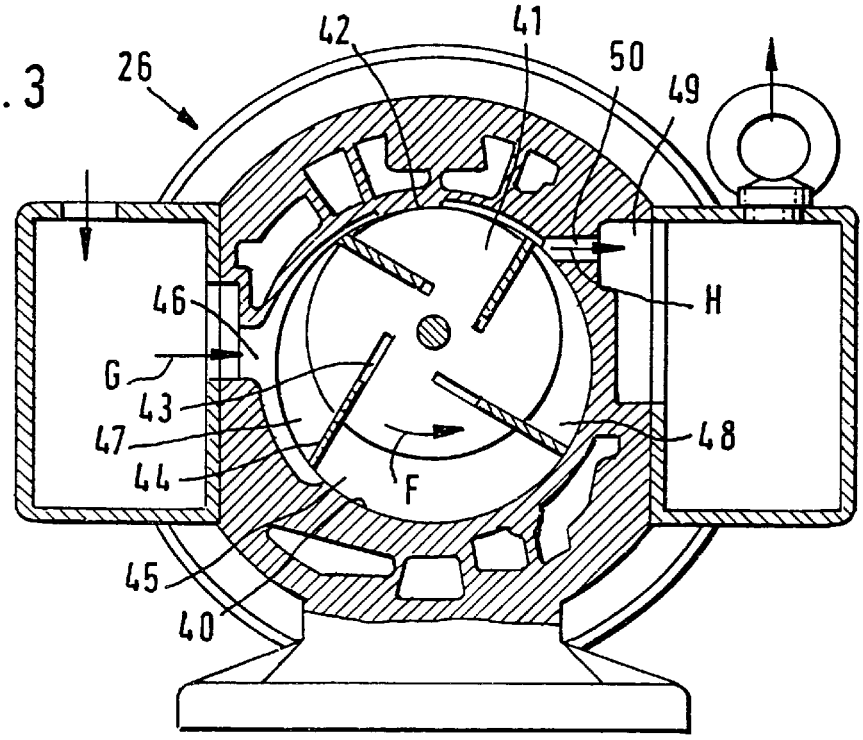
FIG. 3 is a sectional front elevational view of a rotary-vane compressor, forming part of the invention.

FIG. 3 illustrates in more detail the rotary vane compressor 26 attached to the pneumatic output line 37. In a cylindrical housing bore 40 a rotor 41 is eccentrically supported such that in the top region it is almost in contact with the bore wall. In respective slots 43 of the rotor 41 vanes 44 are accommodated which upon rotation of the rotor 41 are, by centrifugal forces, urged outwardly of the rotor 41 and glide, with their outer vane edges, along the cylindrical bore 40. In this manner, between any two vanes a delivery cell 45 is provided whose volume continuously changes during rotation. Air is drawn from the ambient atmosphere into the cell 45 through the intake port 41 until the trailing vane has reached the end of the intake opening 47. At that moment, the intake of air in the cell 45 reaches its greatest volume. As the cell moves away from the intake port, its volume decreases, as a result of which the enclosed air is compressed and the pressure increases. The compression continues until the pressure in the cell 48 exceeds the pressure in the pressure chamber 49 and at that location flows out through the output port 50 which is coupled to conduits 28 and 29 leading to the drawing frame $S_1$ and conduits 30, 31 leading to drawing frame $S_2$. The arrow F indicates the direction of rotation of the rotor 41 while the arrows G and H indicate the entering and exiting air, respectively.

Figure 4:
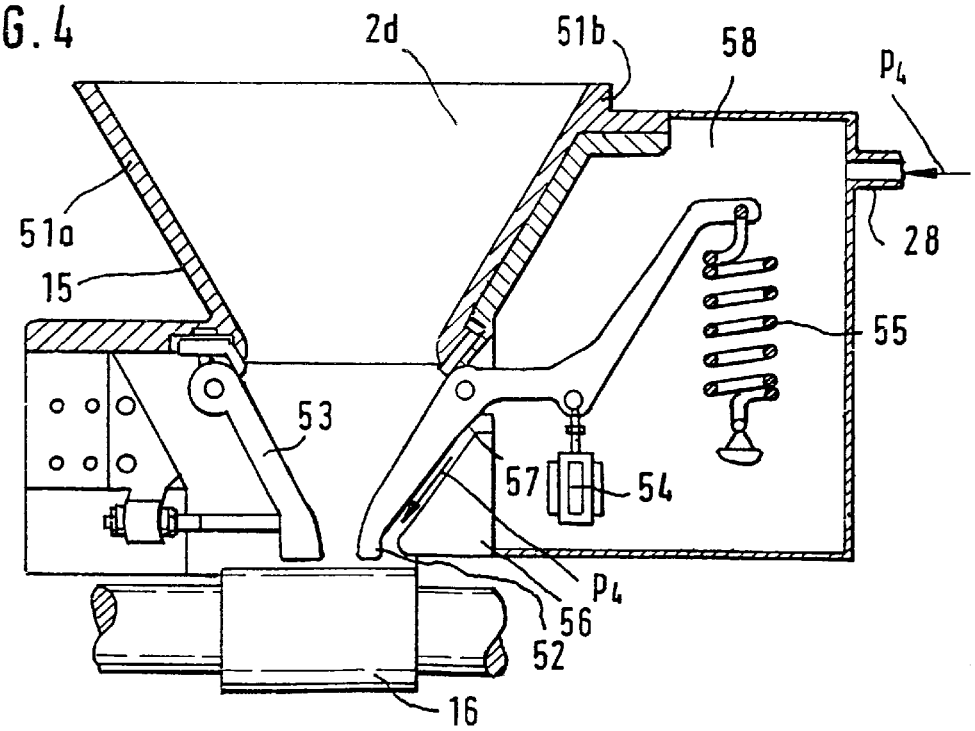
FIG. 4 is a schematic sectional top plan view of a sliver guide in an input region of the drawing frame.

FIG. 4 illustrates an apparatus for measuring the thickness of the running sliver bundle with the sliver guide 15 in the inlet zone of, for example, the drawing frame $S_1$. The walls 51*a*, 51*b* of the sliver guide 15 are at least partially conical for gathering the incoming slivers in a single plane. Beyond the withdrawing roll pair 16,17 (only roll 16 is visible in FIG. 4) which is situated immediately downstream of the sliver guide 15, the slivers of the sliver bundle again diverge. The sliver guide 15 is provided with a biased, movable sensor element 52 which, together with an operationally fixed, but adjustable counterface 53 constitutes a constriction for the throughgoing sliver bundle. The change in position of the sensor element 52 affects a transducer 54 which generates control signals representing the change in the thickness of the sliver bundle as it passes through the guide 15. The slivers in the guide 15 are densified in a single plane and sensed whereas the roll pair 16, 17 withdraws and forwards the sensed sliver bundle. The sensor element 52 and the counterelement 53 extend through the lateral faces 51 and 51*b* of the sliver guide 15. The sensor element 52 biased by the spring 55 reacts during operation to every thickness change of the throughgoing sliver bundle whereby the distance between the sensor element 52 and the adjustable, but operationally stationary counterelement 53 correspondingly changes during thickness variations. Between the sensor member 52 and the stationary counterface 56 a narrow intermediate space 57 is provided. The sliver guide 15 is associated with a closed housing 58 accommodating the transducer (inductive path detector) 54. The inner space of the housing 58 and that of the intermediate space 57 together form a chamber through which a low-pressure pneumatic stream $p_4$ continuously flows, as supplied by the compressor 26 via the conduit 28. Thus, the pneumatic stream enters into the space 58 from the conduit 28 and passes therethrough and thereafter passes through the intermediate space 57 and enters the atmosphere. The pneumatic stream ensures that the intermediate space 57 and the sensor member 52 remain free of dust, fiber fly and the like. At the same time, the pneumatic stream cools the inductive path sensor 54, the housing 58 and the sensor element 52.

Figure 5:
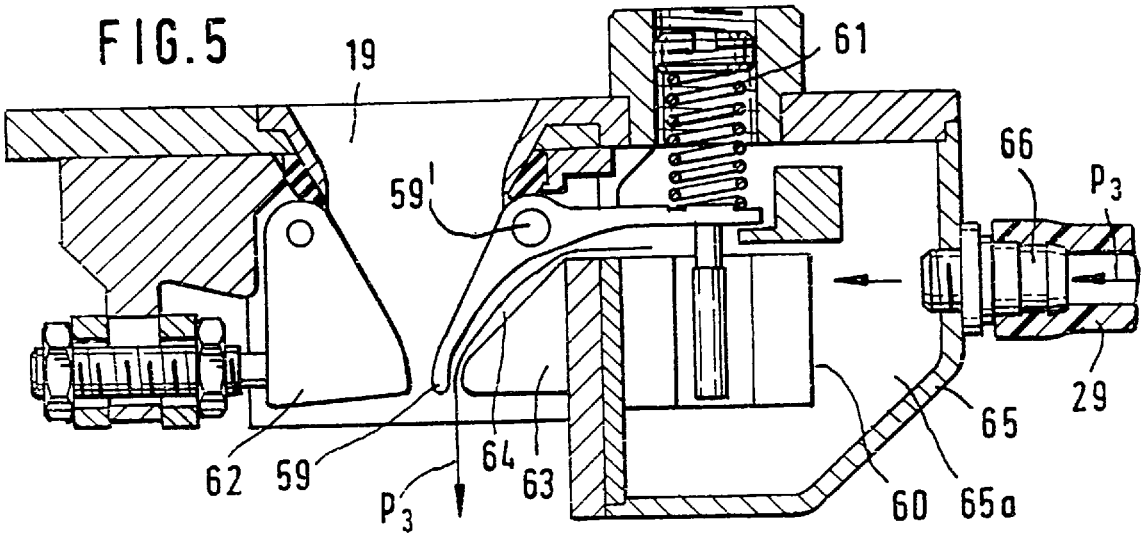
FIG. 5 is a sectional side elevational view of a sliver trumpet with sliver sensor member, arranged in the outlet region of the drawing frame and having an inlet port for a pneumatic hose.

FIG. 5 illustrates a device in the output zone of a drawing unit of a drawing frame which measures the thickness of a sliver bundle and which is formed essentially of a sliver trumpet 19 surrounding the sliver bundle and is situated immediately upstream of the withdrawing roll pair 20, 21. The measuring values of the device are applied to non-illustrated control units. The sliver trumpet 19 has, at its end portion, a recess for receiving a biased, movable sensor member 59, whose inner end forms a constriction with an oppositely located wall portion for the throughgoing sliver bundle and its change in position in response to varying thicknesses of the sliver bundle affects an inductive path sensor 60 for generating control pulses. The sensor member 59 is a two-arm lever rotatable about a pivot 59'. One lever arm is in immediate contact with the fiber material whereas the other lever arm is biased by a spring 61. The sensor element 59 faces an adjustable, but operationally stationary counterelement 62. The sensor element 59 extends through a slot-like recess in the wall face of the sliver trumpet 19. On its side oriented away from the fiber material, the sensor element 59 faces a stationary abutment 63 defining an intermediate space 64 with the sensor element 59. The sensor element 59 and the counterelement 62 are of ferrotitanite (a steel-bound hard substance), rendering them wear resistant to the sliver bundle which runs at high speeds through the measuring trumpet 19. The sensor member 59 has a small mass inertia and thus reacts rapidly to sliver thickness fluctuations. With the sliver trumpet 19 a closed housing 65 is associated which accommodates an inductive path sensor (transducer) 60 composed of a plunger solenoid and a plunger core. The inner space of the housing 65 and the intermediate space 64 together form a chamber through which a pneumatic air stream flows from the low-pressure compressor 26, the conduit 29 and a coupling port 66 held in the housing 65. The pneumatic stream $p_3$ enters through the port 66 into the inner space of the housing 65, thereafter passes through the intermediate space 64 and then enters the atmosphere. Between the sensor member 59 and the walls of the sliver trumpet 19 small gaps are present. The pneumatic stream ensures that the intermediate space 64 and the gaps are free from fiber fly, dust or the like. At the same time, the pneumatic stream cools the inductive path sensor 60, the housing of the sliver trumpet 19 and the sensor element 59.

Turning to FIG. 6, the pressing roll holder 14 of the drawing unit includes an upper part 70 and a lower part 71. The upper part 70 forms a cylinder unit having a cylinder chamber 72 in which a piston 73 is guided by a pressure rod (piston rod) 96 which slides in bushings provided in the upper and lower parts 70, 71. The roll stub shaft 4" of the upper pressing roll 4 extends into a bearing 75 through an opening provided in a holding plate. The bearing 22 receiving the upper roll (pressing roll) 4 extends in a space between the holder 14 and the stub shaft III*a* of the lower roll III. A diaphragm 78 divides the pressure chamber 72 into upper and lower chamber parts. To apply a downward pneumatic pressure to the upper roll 4, air at high pressure $p_1$ is introduced into the upper part of the chamber 72 through a port 77, while the lower part of the cylinder chamber 72 is vented through a port 78. Conversely, for raising the pressure rod 96, the upper part of the cylinder chamber 72 is vented and the lower part of the cylinder chamber 72 is charged with air $p_2$. The ports 77, 78 are connected to a non-illustrated valve coupled to the conduit 24 (FIG. 1). In operation, after a sliver bundle has been guided over the lower rolls I, II and III, the pressing arm 11*a* is pivoted into the working position shown in FIG. 1 and immobilized there, so that the upper pressing rolls 1, 2, 3 and 4 press the sliver bundle against the respective lower rolls I, II and III. Such a pressing effect is generated, on the one hand, by the pressing rods 96 which lie on the respective bearing 22 and, on the other hand, by charging the diaphragm 76 from above with high pressure, pressing down on the rods 96 which may be shifted in the direction of the arrows D, E. The pressure $p_1$ is large.

Figure 7:
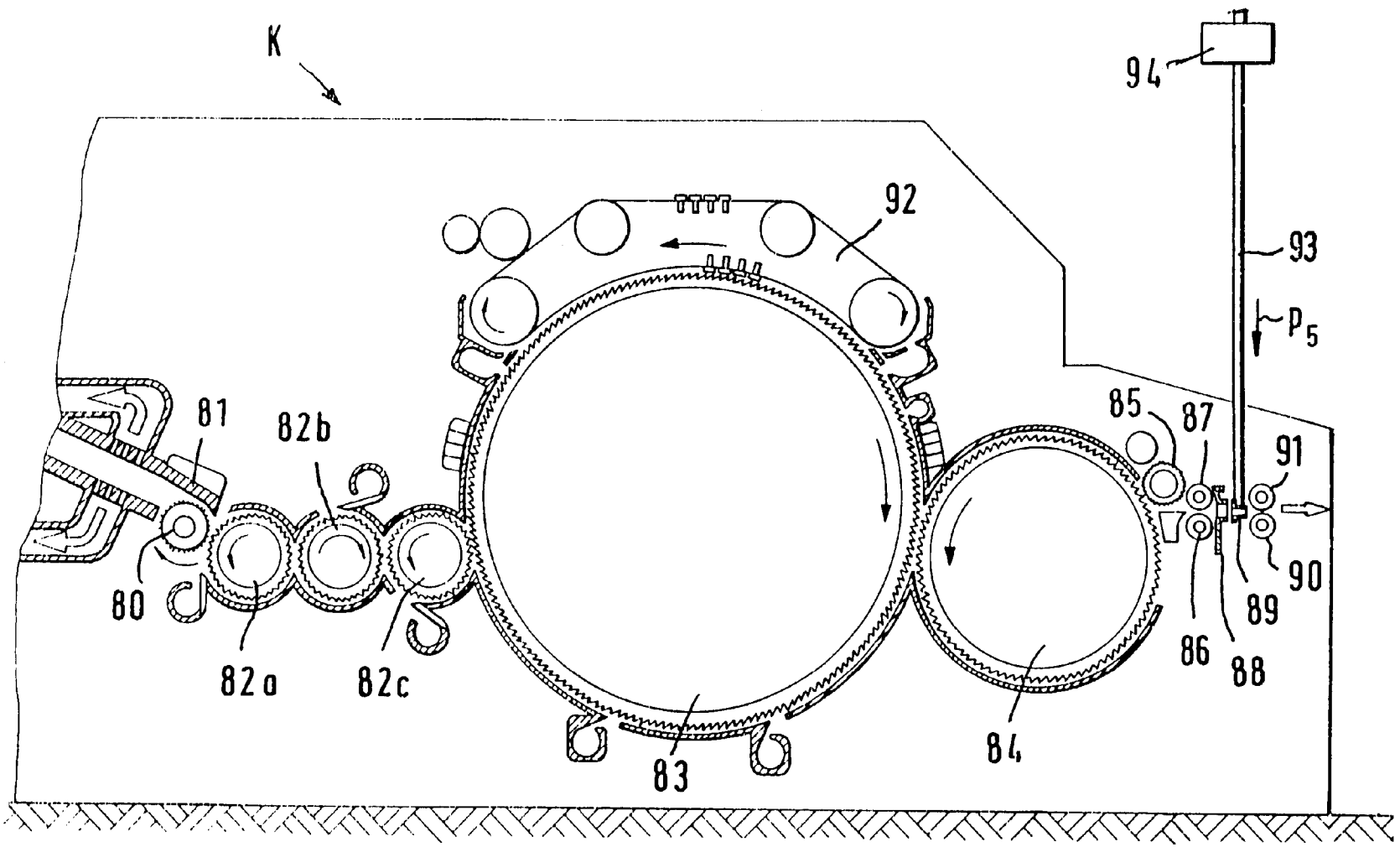
FIG. 7 is a schematic side elevational view of a carding machine incorporating the device according to the invention.

FIG. 7 schematically illustrates a carding machine K which may be, for example, an EXACTACARD DK 803 model, manufactured by Trützschler GmbH & Co. KG. The carding machine K has a feed roll 80, cooperating with a feed plate 81, licker-ins 82*a*, 82*b* and 82*c*, a main carding cylinder 83, a doffer 84, a stripper roll 85, crushing rolls 86 and 87, a web guiding element 88, a sliver trumpet 89, calender rolls 90 and 91 and traveling flats 92. The sliver trumpet 89 is a measuring trumpet sensing the thickness of the throughgoing sliver and may be of a structure such as disclosed in U.S. Pat. No. 5,018,246. The sliver trumpet 89 is adjoined by a non-illustrated housing into which extends a conduit 93 which is coupled with a compressor 94 drawing air from the atmosphere and generating a pneumatic stream of low pressure $p_5$ of, for example, 0.5 bar. Such a pneumatic stream enters the housing to maintain the sensor member of the measuring trumpet 98 free from dust and to cool the same.

It will be understood that the above description of the present invention is susceptible to various modifications, changes and adaptations, and the same are intended to be comprehended within the meaning and range of equivalents of the appended claims.

What is claimed is:

1. In a fiber processing system including a drawing frame including a drawing roll, a mechanism for pressing on said drawing roll and a sliver guiding element through which a sliver runs; and means for supplying a pneumatic stream to the sliver guiding element;

the improvement wherein said means comprises a first device for generating a low pneumatic pressure and a second device for generating a pneumatic pressure higher than said low pneumatic pressure.

2. The fiber processing system as defined in claim 1, wherein a plurality of fiber processing machines and first devices are present and further wherein each fiber processing machine is connected with an own, separate said first device.

3. The fiber processing system as defined in claim 1, wherein said first device is a compressor having rotary vanes.

4. The fiber processing system as defined in claim 1, wherein said low pneumatic pressure is about 0.3–0.5 bar.

5. The fiber processing system as defined in claim 1, wherein said pneumatic pressure generated by said second device is about 6–8 bar.

6. The fiber processing system as defined in claim 1, wherein said fiber processing machine is a drawing frame having an output; further comprising a sliver trumpet arranged at said first output and connected to said device.

7. The fiber processing system as defined in claim 1, wherein said fiber processing machine is a drawing frame having an input; said sliver guiding element being arranged at said input.

8. The fiber processing system as defined in claim 1, wherein said fiber processing machine is a carding machine having an output and said sliver guiding element is a sliver trumpet disposed at said output.

9. In a fiber processing system including a drawing frame having an output; a sliver guiding element through which a sliver runs; said sliver guiding element being located at said output and including a twisting nozzle; and means for supplying a pneumatic stream to the sliver guiding element;

the improvement wherein said means comprises (a) a first device for generating a low pneumatic pressure;

(b) a second device for generating a pneumatic pressure higher than said low pneumatic pressure; and (c) a switching valve connected to said first and second devices, said sliver guiding element and said twisting nozzle; said switching valve having a first state directing a pneumatic pressure from said first device to said sliver guiding element and a second state directing a pneumatic pressure from said second device to said twisting nozzle.

10. A fiber processing system comprising (a) a drawing frame having an output and a sliver guiding element through which a sliver runs;

(b) means for supplying a pneumatic stream to the sliver guiding element; said means including a device for generating a low pneumatic pressure;

(c) an additional sliver guiding element disposed at said outlet; and (d) pneumatic sliver advancing means being included in said additional sliver guiding element and being connected to said device for receiving low pneumatic pressure therefrom for advancing the sliver.

* * * * *